United States Patent [19]

Curtis

[11] Patent Number: 4,522,582

[45] Date of Patent: Jun. 11, 1985

[54] FUEL CONTROL SYSTEM FOR BURNERS

[75] Inventor: Richard D. Curtis, Wichita, Kans.

[73] Assignee: The Coleman Company, Inc., Wichita, Kans.

[21] Appl. No.: 623,833

[22] Filed: Jun. 22, 1984

[51] Int. Cl.[3] ..... F23D 11/38

[52] U.S. Cl. ..... 431/123; 137/244; 137/614.11; 251/122

[58] Field of Search ..... 431/123; 137/244, 614.11; 251/122

[56] References Cited

U.S. PATENT DOCUMENTS 3,807,938 4/1974 Hastings ..... 431/123

4,186,760 2/1980 Hastings ..... 431/123

*Primary Examiner*—Carroll B. Dority, Jr.

[57] ABSTRACT

A fuel control system for burners such as gasoline lanterns provides automatic tip cleaning and adjustable light output. The fuel system includes a burner, a fuel tank, and a fuel conduit for supplying fuel to the burner. A valve is interposed in the fuel conduit for opening and closing fuel flow. The conduit has a fuel outlet orifice, and a tip cleaning needle is reciprocable within the conduit for cleaning the orifice. The valve and the tip cleaning needle are controlled by a rotatable control shaft which extends perpendicularly to the conduit and which includes an eccentric pin. The eccentric pin extends above a valve block into a slot in an eccentric follower. The control shaft is rotatable between an off position in which the valve is closed and the end of the tip cleaning needle is positioned in the orifice, a dim position in which the valve is on and the tip cleaning needle is positioned in the orifice, and a full on position in which the valve is open and the tip cleaning needle is withdrawn from the orifice.

12 Claims, 19 Drawing Figures

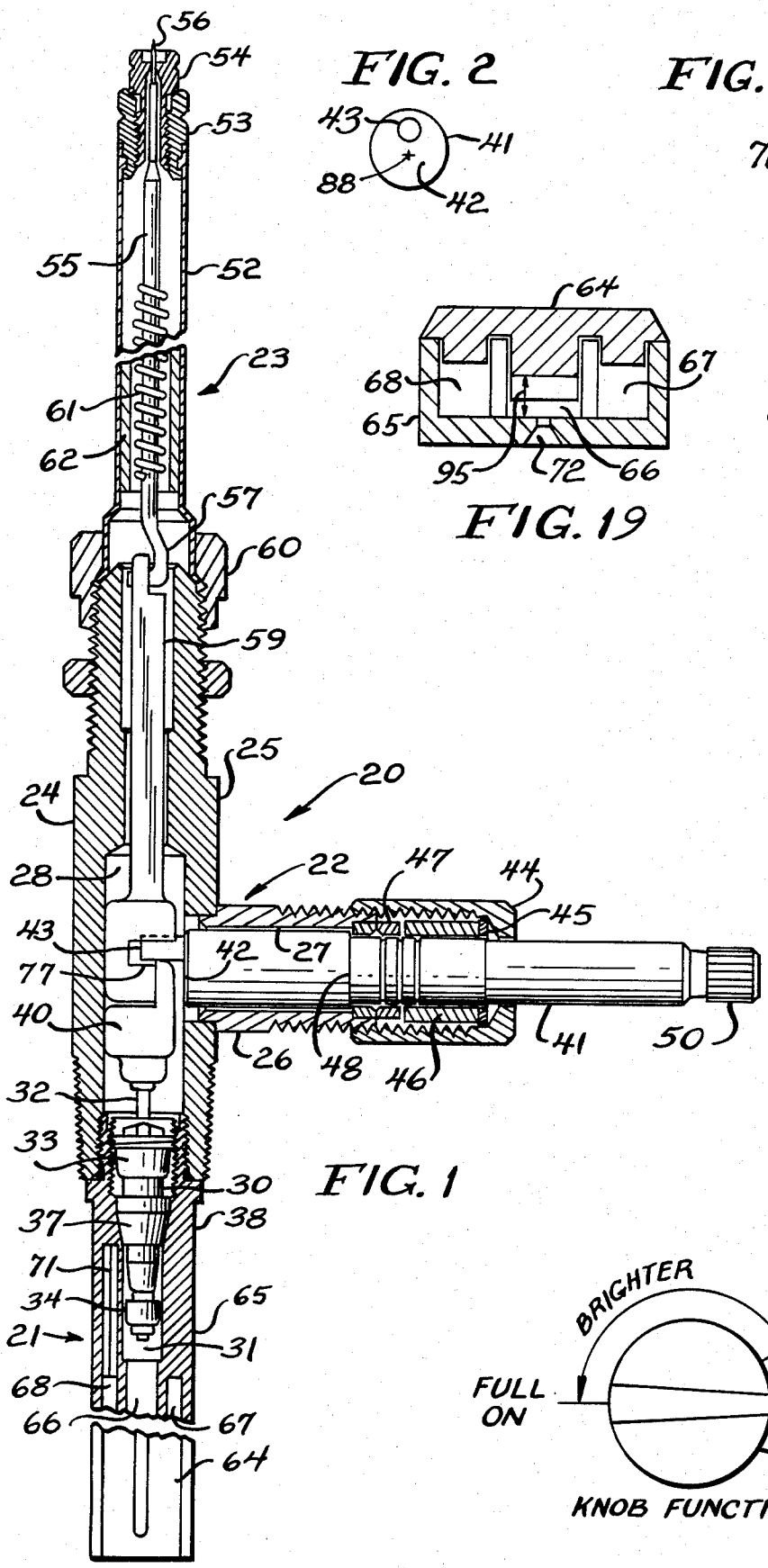
FIG. 1
FIG. 2
FIG. 19
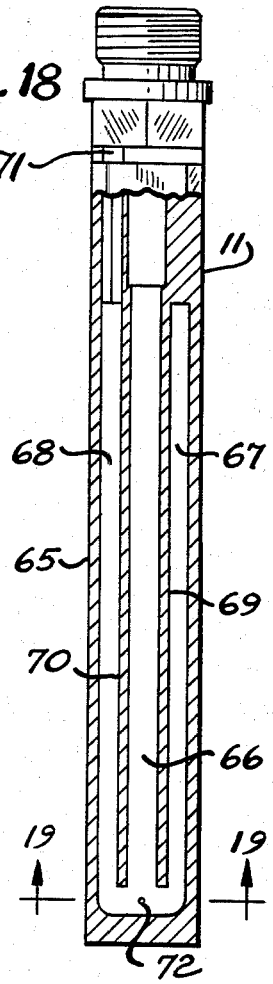
FIG. 18
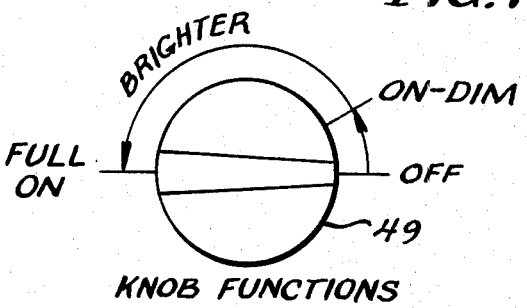
FIG. 17

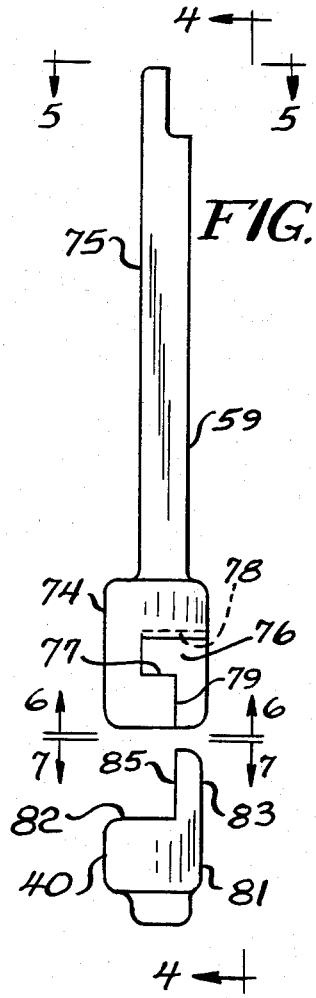
FIG. 3
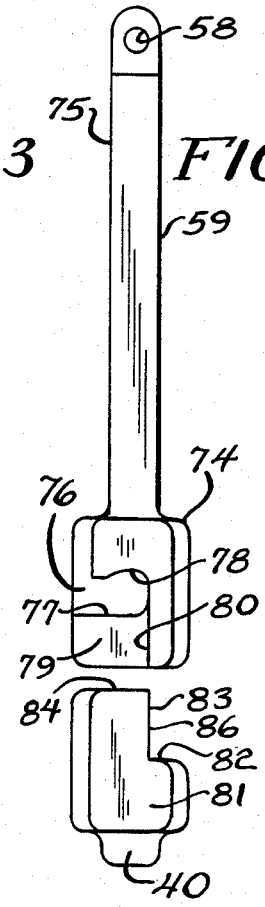
FIG. 4
FIG. 9
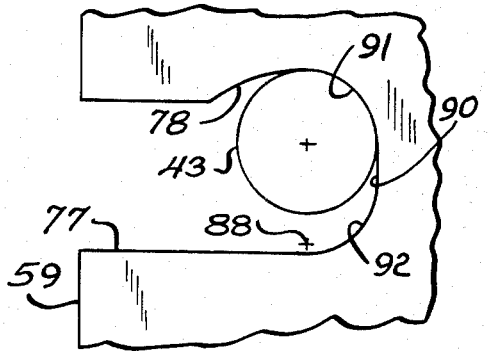
FIG. 10
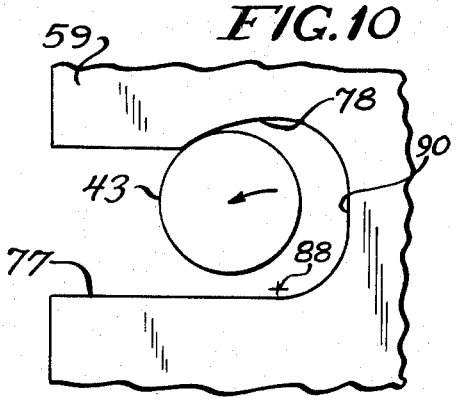
FIG. 11
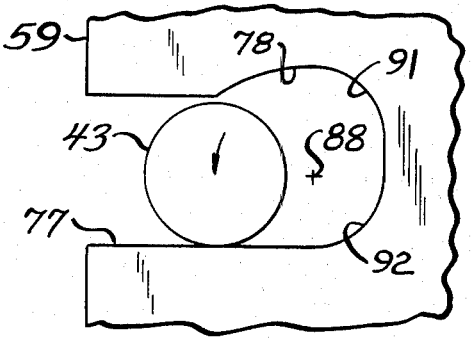
FIG. 5
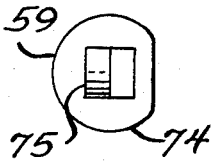
FIG. 6
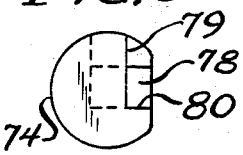
FIG. 8
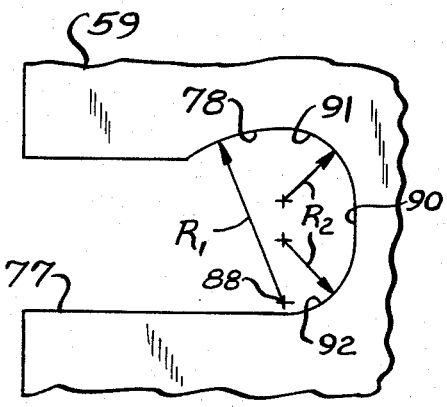
FIG. 12
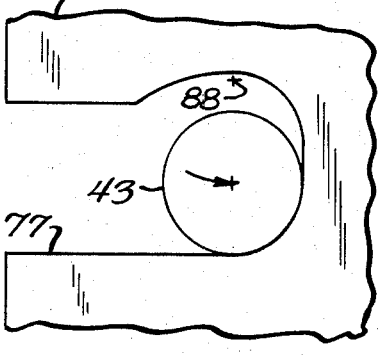
FIG. 7
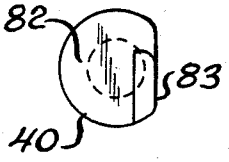

OFF

ON - DIM

BRIGHTER

FULL-ON

FUEL CONTROL SYSTEM FOR BURNERS

BACKGROUND

This invention relates to vaporized fuel burners such as gasoline lanterns and camp stoves, and, more particularly, to a fuel control assembly for vaporized fuel burners which includes a single control member for operating the fuel flow valve, the orifice cleaner, and the inlet restricting member.

The invention is an improvement over the fuel control assembly for lanterns and stoves which is described in U.S. Pat. No. 4,186,760, U.S. Pat. No. Re. 29,457, U.S. Pat. No. 3,876,364, and Canadian Pat. No. 973,082.

As described in said patents, vaporized fuel burners such as lanterns and camp stoves generally include a fuel tank, a fuel conduit including a generator tube, and burning means which is supplied with a mixture of fuel from the conduit and air. The generator tube is positioned adjacent the burning means so that fuel passing through the generator tube is vaporized, and a valve is interposed in the fuel conduit to open and close the fuel passage therethrough. A cleaner rod is usually mounted within the generator tube and is movable into and out of the discharge orifice of the generator to clean the orifice and, if desired, to regulate the flow of fuel therethrough. When the burning means is to be lighted and before the generator tube is heated sufficiently to vaporize the fuel, a restricting rod is used to restrict the flow of fuel into a chamber below a fuel tube to permit air to flow through the chamber and become entrained with the fuel passing into the fuel tube. This rod is removed from the fuel inlet when the generator is heated sufficiently to vaporize the fuel.

The fuel control assemblies described in said patents utilize a single control member for actuating the shut off valve, the generator orifice cleaner rod, and the inlet restricting rod in the proper sequence. Rotation of the control member from an off position to a clean position moves the cleaner rod into the generator orifice to clean the orifice; rotation of the control member from the clean position to a light position moves the cleaner rod out of the generator orifice, opens the shut off valve, and moves the restricting portion of the inlet restricting rod into the fuel inlet to restrict the flow of fuel and to permit the burner to be lighted; and rotation of the control member from the light position to a run position moves the restricting portion of the inlet restricting rod out of the fuel inlet to permit fuel to flow through the inlet unrestricted.

Another prior art lantern was similar to that described in U.S. Pat. No. 4,186,760 but omitted the inlet restricting rod. The cleaner rod was used not only for cleaning the orifice but for regulating the flow of fuel through the orifice.

SUMMARY OF THE INVENTION

The invention allows the cleaner rod to be used for adjusting the fuel flow through the orifice by using an eccentric follower member for controlling the cleaner rod and a separate valve block for controlling the valve. The eccentric follower and the valve block are correlated with the control shaft so that the eccentric member does not move when the control shaft is rotated to its on position to open the valve. Thereafter, further rotation of the control shaft withdraws the cleaner rod from the orifice and meters the flow of fuel through the orifice. The eccentric follower is provided with a uniquely shaped slot which enables the control shaft to rotate to open the valve without moving the cleaner rod and which provides stops for the control shaft in the off and full on positions.

DESCRIPTION OF THE DRAWING

The invention will be explained in conjunction with an illustrative embodiment shown in the accompanying drawing, in which:

FIG. 1 is an elevational sectional view, partially broken away, of a fuel control assembly formed in accordance with the invention;

FIG. 2 is an end elevational view of the control shaft of FIG. 1;

FIG. 3 is an exploded view of the eccentric follower and valve block of FIG. 1;

FIG. 4 is a view of the eccentric follower and valve block taken along the line 4—4 of FIG. 3;

FIG. 5 is a top plan view of the eccentric follower taken along the line 5—5 of FIG. 3;

FIG. 6 is a bottom plan view of the eccentric follower taken along the line 6—6 of FIG. 3;

FIG. 7 is a top plan view of the valve block taken along the line 7—7 of FIG. 3;

FIG. 8 is an enlarged fragmentary view of a portion of FIG. 4 showing the slot in the eccentric follower;

FIG. 9 illustrates the position of the eccentric pin in the slot of the eccentric follower in the off position;

FIG. 10 is a view similar to FIG. 9 illustrating the position of the eccentric pin in the on-dim position;

FIG. 11 is a view similar to FIGS. 9 and 10 illustrating the position of the eccentric pin when the cleaning needle has been partially withdrawn from the orifice;

FIG. 12 is a view similar to FIGS. 9–11 showing the position of the eccentric pin in the full-on position;

FIG. 17 is an elevational view of the control knob showing the various positions to which it can be rotated;

FIG. 18 is a sectional view of the fuel inlet tube; and

FIG. 19 is a sectional view taken along the line 19—19 of FIG. 18.

DECRIPTION OF SPECIFIC EMBODIMENT

Figure 13:
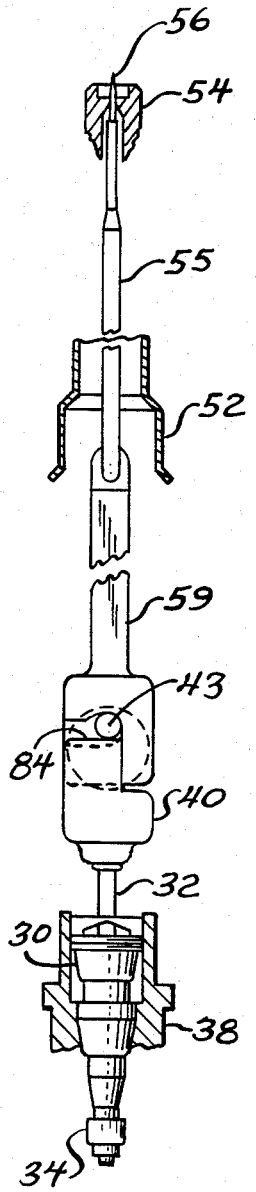
FIG. 13 is a fragmentary elevational view, partially broken away, of the fuel control assembly in the off position.

Referring first to FIG. 1, the numeral 20 designates generally a fuel control assembly of the type described in U.S. Pat. No. 4,186,760 and U.S. Pat. No. Re. 29,457, the disclosures of which are incorporated herein by reference. These patents may be referred to for the details of the assembly and for the relationship between the fuel control assembly and the fuel burner, for example, in a gasoline lantern or a camp stove.

The fuel control assembly includes a fuel inlet assembly 21, a valve assembly 22, and a generator assembly 23. As described in said patents, these assemblies are interconnected and provide a fuel conduit or flow passage for the fuel. Fuel is conducted from a fuel tank through the fuel control assembly to a fuel burner assembly, and the flow passage through the fuel control assembly is opened or closed by the valve assembly.

The valve assembly includes a generally T-shaped valve body 24 which includes an elongated tube 25 and a cylindrical shaft housing 26 which extends perpendicular to the tube 25 and which is secured thereto, as by silver soldering. The shaft housing 26 is provided with a central bore 27, and the tube 25 is provided with a fuel passage 28.

Figure 14:
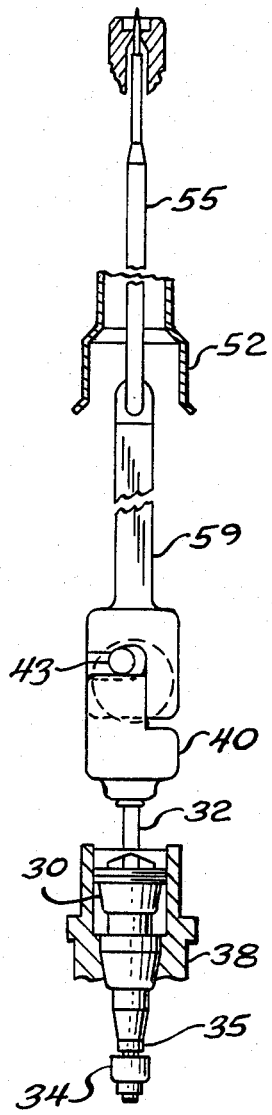
FIG. 14 is a view similar to FIG. 13 showing the fuel control assembly in the on-dim position.

The fuel inlet assembly 21 is screwed into the lower end of the tube 25, and a conventional tire valve core 30 is screwed into the internally threaded upper end of the fuel passage 31 through the inlet assembly. The valve core includes a stem 32 which is reciprocable within a valve body 33 and which is connected to a seal member 34 at the bottom of the valve. The stem is spring-biased to urge the seal member into engagement with a valve seat 35 (FIGS. 14–16) to close the valve. The valve core includes a frusto-conical central portion 37 which seats in a correspondingly shaped portion 38 of the fuel inlet assembly so that fuel can flow through the inlet assembly only when the valve is open.

A valve block 40 engages the upper end of the valve stem 32 and is movable downwardly by a control shaft 41 within the shaft housing 26. The control shaft 41 is rotatable within the shaft housing and has a flat inner end surface 42 and an eccentric pin 43 which is eccentrically mounted with respect to the axis of the control shaft (see also FIG. 2) and which extends above the valve block 40. The control shaft is retained within the shaft housing by a nut 44 which engages a washer 45, packing 46, and retaining ring 47. The retaining ring engages a shoulder 48 on the shaft. A conventional control knob 49 (FIG. 17) can be mounted on the knurled outer end 50 of the control shaft.

The generator assembly 23 is similar to the generator assembly described in U.S. Pat. No. 4,186,760 and U.S. Pat. No. Re. 29,457. The generator assembly includes a generator tube 52, a bushing 53 which is mounted on the upper end of the tube, and a gas tip 54 which is mounted within the bushing and which is provided with a fuel outlet orifice through which fuel passes from the generator to the burner assembly. A cleaner rod 55 extends axially within the generator tube, and a cleaner needle 56 is mounted on the upper end of the cleaner rod and is sized to fit relatively snugly within the outlet orifice of the generator assembly when the cleaner rod is reciprocated upwardly to remove carbon and other material from the orifice. The lower end of the cleaner rod includes a connecting portion 57 which extends perpendicularly to the axis of the generator tube and which is inserted into an opening 58 (FIG. 4) in an eccentric follower 59. The bottom of the generator tube is connected to the upper end of the valve body by a nut 60 which is threadedly engaged with the valve body. The cleaner rod is reciprocable within a wire helix 61 and an asbestos tube 62.

The fuel inlet assembly 11 illustrated in the drawing is formed from two molded plastic halves 64 and 65 which are joined together to form a central fuel passage 66 and a pair of outer air passages 67 and 68. The air passages are separated from the fuel passage by walls 69 and 70 which terminate above the bottom of the fuel inlet assembly (see FIG. 18). The air passages 67 and 68 communicate with the outside of the fuel inlet assembly through an air opening 71 in the upper portion of the assembly, and the fuel passage 66 communicates with the outside of the fuel inlet assembly through a fuel inlet opening 72 (FIG. 18) at the bottom of the assembly.

The fuel inlet assembly is inserted into a source of fuel, such as the fount or fuel tank of a gasoline lantern, so that the air opening 71 is above the fuel level and the fuel inlet opening 72 is below the fuel level. Before the valve is opened, liquid fuel fills the air passages 67 and 68 of the fuel inlet assembly 11 to the level of fuel in the fount. Fuel passage 67 is also filled with fuel to a level at least equal to the fuel level in the fount. When the valve is opened, this fuel is forced into the generator to provide a rich fuel to air mixture for initial ignition. Pressurized air in the fuel tank then flows through the air opening 71 and the air passages 67 and 68 and becomes entrained with fuel which flows upwardly through the fuel passage 66 and is discharged into the burner through the orifice in the gas tip 54. The richness of the fuel and air mixture for initial lighting may be controlled by adjusting the aggregate volumetric capacity of the air and fuel passages 66, 67, and 68. The ratio of fuel to air during the warm up of the generator may be controlled in part by adjusting the distance 95 between the fuel inlet orifice 72 in one side 65 of the fuel inlet assembly 11 and the opposite side 64 of the fuel inlet assembly.

The fuel and air mixture is ignited by a match at the burner, for example, the mantle of a gasoline lantern. The mantle is adjacent the generator tube, and gradually heats the generator tube sufficiently to vaporize the fuel therein. Flow through the orifice of the gas tip 54 is thereby impeded, and air ceases to enter the fuel passage 66 when the lower ends of air passages 67 and 68 become flooded with liquid fuel. When air stops flowing through the fuel inlet assembly, the lighting phase is complete.

Turning now to FIGS. 3–8, the eccentric member 59 includes an enlarged lower end portion 74 and a narrow rod-like portion 75 which is connected to the cleaner rod 55. The enlarged lower end portion is provided with a recess or slot 76. The recess extends inwardly over a shoulder 77, and the upper end of the recess is defined by a flat surface 79 which extends downwardly from the shoulder 77 and a flat surface 80 which extends downwardly from the arcuate wall 78. The eccentric pin 43 on the control shaft 41 extends into the upper portion of the recess when the control shaft is in its off position as illustrated in FIGS. 9 and 13. The eccentric pin extends into the recess above the shoulder 77 (FIG. 1).

The valve block 40 includes a lower end portion 81 having a flat upper surface 82 and a projection 83 which extends upwardly from one quadrant of the flat upper surface 82 (see FIG. 7). The projection 83 terminates in a flat top surface 84 (FIG. 4) and includes a flat surface 85 which is slidable along the flat surface 79 of the eccentric member and a flat surface 86 which is slidable along the flat surface 80 of the eccentric member.

FIGS. 1, 9, and 13 illustrate the fuel control assembly in the off position. The eccentric pin 43 is positioned within the arcuate portion 78 of the recess 76 and extends above the top surface 84 of the valve block 40 and above the shoulder 77 of the eccentric member 59. The spring of the valve core 30 forces the valve stem 32 and the valve block 40 upwardly so that the top surface 84 of the valve block is contacting or adjacent to the eccentric pin 43 and the flat surface 82 of the valve block is contacting or adjacent to the bottom surface of the eccentric member 59.

Referring to FIGS. 2, 8, and 9, the eccentric pin 43 is offset from the axis of rotation 88 of the control shaft 41, and the arcuate surface 78 has the same radius of curvature $R_1$ as the radius between the axis 88 and the outer portion of the eccentric pin 43. Accordingly, as the control shaft initially rotates counterclockwise from the off position illustrated in FIGS. 9 and 13, the eccentric pin 43 engages the top surface 84 of the valve block 40 but does not engage the shoulder 77 of the eccentric member 59. The eccentric pin therefore moves the valve block 40 downwardly to open the valve 30 without moving the eccentric member 59, and the cleaning needle 56 remains in the orifice of the gas tip 54. The eccentric pin 43 does not move the eccentric member 59 until the eccentric pin engages the shoulder 77 of the eccentric member, and this does not occur until the control shaft rotates almost 90°. The valve stem 32 need move only a short distance downwardly to open the valve 30 fully, and the valve is fully opened before the eccentric pin engages the shoulder 77.

FIG. 17 illustrates the rotational positions of the control knob 49 and the control shaft 41. When the control shaft is rotated less than 90° to a position indicated as "ON-DIM" in FIGS. 17 and 14, the valve 30 is fully open, and the cleaning needle 56 has not moved and remains in the orifice of the generator assembly. The needle therefore restricts flow of fuel through the orifice, and the burner operates at a low or dim setting. As the control shaft rotates beyond the ON-DIM position, the eccentric pin 43 engages the abutment or shoulder 77 of the eccentric follower 59 and moves the eccentric follower downwardly. The cleaning needle 56 is therefore gradually withdrawn from the orifice as the control shaft is rotated, and the cleaning needle thereby meters flow of fuel through the orifice. The metering ability of the needle can be enhanced by tapering the needle on one side to provide linear adjustment of fuel flow.

Figure 15:
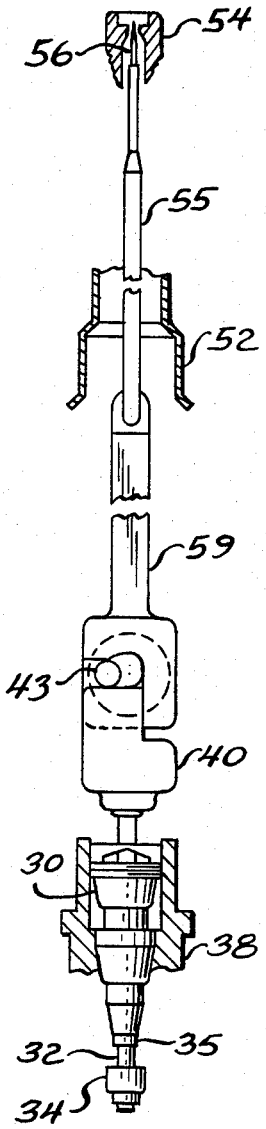
FIG. 15 is a view similar to FIGS. 13 and 14 showing the fuel control assembly in a brighter position.

FIG. 15 illustrates the position of the cleaning needle 56 after the control shaft has been rotated somewhat beyond 90° from the off position. The cleaning needle has been partially withdrawn from the orifice but still partially resricts fuel flow through the orifice. This corresponds to FIG. 11 in which the abutment 77 of the eccentric follower has been moved downwardly from its FIG. 10 position by rotation of the eccentric pin 43 about the axis 88.

Figure 16:
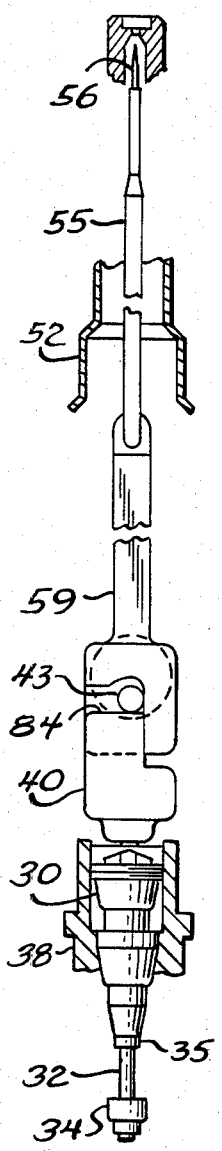
FIG. 16 is a view similar to FIGS. 13–15 showing the fuel control assembly in the full-on position.

The cleaning needle 56 is fully withdrawn from the orifice when the control shaft is rotated 180° to the "FULL ON" position of FIGS. 16 and 17. In this position fuel flows through the orifice at the maximum rate, and the burner operates at its brightest or hottest condition.

It will be appreciated from FIGS. 13–16 that the valve stem 32 will be continually depressed by the eccentric pin 43 and the valve block 40 as the control shaft rotates counterclockwise from the off position. However, the valve reaches its full open position after the valve stem 32 is depressed a short distance, and the additional movement of the valve stem does not increase fuel flow through the valve.

The recess 76 in the eccentric follower 59 not only controls movement of the cleaning needle but provides stops for the off and full on positions. Referring to FIG. 9, when the eccentric pin 43 is in the off position, it engages the surface 90 on the eccentric follower which prevents clockwise movement of the eccentric pin beyond the off position. The eccentric follower is prevented from moving to the right as viewed in FIG. 9 by its confinement within the fuel passage 28 of the valve body 24. The upper portion 91 of the stop surface 90 has the same radius of curvature $R_2$ (FIG. 8) as the surface of the eccentric pin so that the pin seats against the stop surface 90.

After the eccentric pin rotates 180° counterclockwise and reaches the full on position, it again engages the stop surface 90 and is prevented from rotating beyond the full on position. The lower portion 92 of the stop surface 90 also has the same radius of curvature $R_2$ as the surface of the eccentric pin.

When the knob 49 is rotated clockwise from the full on position, the movement of the valve block 40, eccentric member 59, and cleaning needle 56 is reversed. As the eccentric pin 43 rotates clockwise from the full on position of FIGS. 12 and 16, the spring-biased valve stem 32 moves the valve block 40 upwardly with the eccentric pin 43. When the eccentric pin 43 has rotated sufficiently to engage the upper surface of the recess 76 in the eccentric member, the eccentric member begins to move upwardly to move the cleaning needle 56 toward the orifice in the gas tip 54. Further clockwise movement of the eccentric pin moves the cleaning needle into the orifice, thereby metering gas flow and dimming the light output. When the eccentric pin 43 reaches the position illustrated in FIGS. 9 and 13, it engages the stop surface 90. In this position the valve 30 is closed.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. In a fuel burning apparatus having a fuel tank, fuel burning means for burning fuel supplied by the tank, fuel conduit means for supplying fuel from the tank to the fuel burning means, the fuel conduit means having a first end provided with a fuel inlet opening positioned within the tank and a second end provided with a fuel outlet orifice for supplying fuel to the fuel burning means, a cleaning rod movable within the fuel conduit means and having an end which is movable within the fuel outlet orifice of the fuel conduit means, and a valve in the fuel conduit means movable between a closed position in which fuel flow through the fuel conduit means is prevented and an open position in which fuel flow through the conduit means is permitted, the improvement comprising:

(a) a control shaft rotatably mounted on the fuel conduit means and extending generally perpendicularly to the cleaning rod, (b) an eccentric pin mounted on the control shaft eccentrically with respect to the axis of rotation of the control shaft, (c) an eccentric follower member connected to the cleaning rod and having a shoulder which is engageable with the eccentric pin and a curved surface opposite said shoulder, (d) a valve block movably mounted within the fuel conduit means and being engageable with the eccentric pin as the eccentric pin rotates with the control shaft, the valve block being engageable with the valve for moving the valve from the closed position to the open position, the eccentric pin being rotatable between:

(i) a first position in which the eccentric pin engages the curved surface but does not engage said shoulder of the eccentric follower and said end of the cleaning rod is positioned within the fuel outlet orifice and the valve is closed, (ii) a second position in which the eccentric pin engages the curved surface but does not engage said shoulder of the eccentric follower and said end of the cleaning rod is positioned within the fuel outlet orifice and in which the eccentric pin engages the valve block and maintains the valve block in position to open the valve, and (iii) a third position in which the eccentric pin engages said shoulder of the eccentric follower and said end of the cleaning rod is at least partially withdrawn from the fuel outlet orifice and in which the eccentric pin engages the valve block and maintains the valve block in position to open the valve.

2. The structure of claim 1 in which the eccentric pin engages said shoulder of the eccentric follower and gradually withdraws said end of the cleaning rod from the fuel outlet orifice as the eccentric pin moves from its second position to its third position.

3. The structure of claim 1 in which the eccentric follower includes a stop surface which is engageable with the eccentric pin for preventing the eccentric pin from rotating from beyond its first position away from its second position.

4. The structure of claim 3 in which the eccentric follower includes a stop surface which is engageable with the eccentric pin for preventing the eccentric pin from rotating from its second position beyond its third position.

5. The structure of claim 1 in which the eccentric follower includes a stop surface which is engageable with the eccentric pin for preventing the eccentric pin from rotating from its second position beyond its third position.

6. The structure of claim 1 in which the valve block includes a shoulder which is positioned between said surface of the eccentric follower and the fuel outlet orifice when the eccentric pin is in its first position whereby the eccentric pin engages said surface of the valve block but not said shoulder of the eccentric follower as the eccentric pin rotates from its first to its second position.

7. The structure of claim 1 in which the valve is spring-biased to its closed position whereby the valve moves from its open position to its closed position as the eccentric pin rotates from its second position to its first position.

8. The structure of claim 1 in which the eccentric pin is rotatable to a fourth position in which the eccentric pin engages said shoulder of the eccentric follower and said end of the cleaning rod is fully withdrawn from the fuel outlet orifice and in which the eccentric pin engages the valve block and maintains the valve block in position to open the valve.

9. The structure of claim 1 in which the valve block is positioned between the valve and the eccentric follower and includes a projecting portion which extends away from the valve and beyond said shoulder of the eccentric follower whereby the eccentric pin can engage the projecting portion of the valve block and move the valve block toward the valve before the eccentric pin engages said shoulder of the eccentric follower.

10. The structure of claim 9 in which the eccentric pin extends axially over both the projecting portion of the valve block and said shoulder of the eccentric follower.

11. The structure of claim 9 in which the eccentric follower is provided with a recess adjacent said projecting portion of the valve block which includes an abutment surface which provides said shoulder of the eccentric follower and said curved surface, the end of the projecting portion of the valve block being positioned between the curved surface and the abutment surface of the recess when the eccentric pin is in its first position whereby the eccentric pin engages the curved surface of the recess and the projecting portion but not the abutment surface of the recess when the eccentric pin is in its first position and the eccentric pin moves the projecting portion of the valve block toward the valve as the eccentric pin moves from its first position to its second position and the eccentric pin engages the abutment surface of the recess as it moves from its second position to its third position.

12. The structure of claim 11 in which said recess is provided in a side portion of the eccentric follower which extends generally perpendicularly to the eccentric pin, said projecting portion of the valve block extending along said side portion of the eccentric follower.

* * * * *

UNITED STATES PATENT AND TRADEMARK OFFICE

CERTIFICATE OF CORRECTION

PATENT NO. : 4,522,582

DATED : June 11, 1985

INVENTOR(S) : Richard D. Curtis

It is certified that error appears in the above-identified patent and that said Letters Patent is hereby corrected as shown below:

Col. 7, line 43 change "shoulder" to --surface-- and in line 44 change "surface" to --shoulder--.

Signed and Sealed this

*Fourteenth* Day of *January 1986*

[SEAL]

*Attest:*

DONALD J. QUIGG

*Attesting Officer*

*Commissioner of Patents and Trademarks*